US005253871A

United States Patent [19]

Viollaz

[11] Patent Number: 5,253,871

[45] Date of Patent: Oct. 19, 1993

[54] GOLF BALL

[75] Inventor: Francois Viollaz, Evian, France

[73] Assignee: Taylor Made Golf Company, Inc., Carlsbad, Calif.

[21] Appl. No.: 745,285

[22] Filed: Aug. 14, 1991

[30] Foreign Application Priority Data

Aug. 22, 1990 [FR] France ..... 90 10696

[51] Int. Cl.[5] ..... A63B 37/02; A63B 37/06

[52] U.S. Cl. ..... 273/228; 273/230; 273/235 R; 525/92; 525/175; 525/176; 525/183

[58] Field of Search ..... 428/403, 407; 273/228, 273/230, 235 R; 525/92, 175, 176, 183

[56] References Cited

U.S. PATENT DOCUMENTS

| | | | |
|---|---|---|---|
| 4,234,184 | 11/1980 | Deleens et al. | 273/235 R |
| 4,295,652 | 10/1981 | Saito et al. | 273/235 R |
| 4,398,000 | 8/1983 | Kataoka et al. | 273/235 R X |
| 4,625,964 | 12/1986 | Yamada | 273/230 |
| 4,674,751 | 6/1987 | Molitor et al. | 273/235 R |
| 4,848,770 | 7/1989 | Shama | 273/228 |
| 5,068,151 | 11/1991 | Nakamura | 428/407 |

FOREIGN PATENT DOCUMENTS

| | | |
|---|---|---|
| 1121931 | 4/1982 | Canada . |
| 1169993 | 6/1984 | Canada . |
| 2273021 | 12/1975 | France . |
| 2418250 | 9/1979 | France . |
| 2086235 | 5/1982 | United Kingdom . |

OTHER PUBLICATIONS

Database Chemical Abstracts, vol. 106, No. 6, 1986, Abstract No. 34210r, Columbus, OH and Japanese Patent Publication No. 61-168,374 (M. Kimiko), Jul. 30, 1986.

French Search Report and Annex.

*Primary Examiner*—Paul J. Thibodeau
*Assistant Examiner*—D. S. Nakarani
*Attorney, Agent, or Firm*—Sandler, Greenblum & Bernstein

[57] ABSTRACT

The invention concerns a golf ball constituted of a three part structure, constituted of an elastomer core, an intermediate layer, and a thermoplastic envelope. The intermediate layer is made of a thermoplastic material containing at least 10%, and preferably at least 35% of ether block copolymer. The material may also be advantageously constituted of ether block copolymer to which is added 0 to 90% of ionomer(s) with respect to the total weight of the compound.

20 Claims, 1 Drawing Sheet

GOLF BALL

BACKGROUND OF THE INVENTION

1. Field of the Invention

The present invention relates to golf balls, and especially, to the structure of a ball composed of several parts.

2. Description of Background and Other Information

Prior art can be divided into two main types of golf balls. On the one hand, there are the so-called "two-piece" solid balls. Their properties are derived from the combination of a rubber mono-piece spherical core and a hard ionomer resin thermoplastic envelope. The main advantage of these balls is their very high performance during long shots by virtue of their considerable initial speed. However, they feel hard on impact, the main reason for this being their substantial rigidity. Thus, during short shots or approach shots, the initial high speed and small contact surface hinders control of the ball. Also, lack of rotational speed adversely affects the behavior of the ball when it falls.

On the other hand, "three piece" rolled balls are known. These are constituted of a solid or liquid central core, of a rubber thread winding and of a thermoplastic envelope either made of ionomer resin or of balata type rubber of a thickness of 1 to 2 mm. The high deformability of the external layers of the rolled core results in a feeling of softness at impact, due to a smaller rate of compression and consequently a greater contact surface. However, this type of ball adversely affects performance during long shots, as opposed to the "two piece" balls.

SUMMARY OF THE INVENTION

The object of the present invention is to propose a new ball, whose performance will be satisfactory in every aspect of the game, that is, a ball with considerable initial speed, close to that of faster balls, and one having good feel and good control during approach shots. The golf ball of the present invention will also enable shots to be reproduced, and it will have excellent durability.

Another object of the invention is to enable a wide range of performances to be covered, responding to the precise requirements of users, and at the same time, requiring only very minimal variation in the parameters.

Another object of the invention is to enable the use of a reliable and automatic manufacturing method, enabling high productivity by virtue of its structure and the choice of materials used.

The desired properties are obtained according to the present invention by a structure made of three parts. The golf ball is constituted of an elastomer core, an intermediate layer and a thermoplastic cover, characterized mainly by the fact that the intermediate layer is made of a thermoplastic material containing at least 10%, and preferably at least 35% of ether block copolymer.

By ether block copolymer sequenced copolymers formed from blocks that have- certain chain lengths for their diverse components are meant.

They have two phases: one flexible, the ether block, and the other rigid. By playing with the nature and proportion of these phases, one can obtain a rather wide variety of products that range from being extremely flexible to relatively rigid.

Among these copolymers, those that are especially preferred are amide block copolymers on the one hand and ester block copolyethers on the other hand. The amide block copolymers (PEBA) are well known under the trademark PEBAX® commercialized by ATOCHEM. The use of GRILAMID® commercialized by the company EMS or VESTAMID® by HÜLS are noted.

As for ester block polyethers (PEBE), these are products that have a rigid phase of the terephtalate polybutadiene type (PBT). These are known under the trademark HYTREL® by the company DUPONT DE NEMOURS or ARNITEL® by the company AKZO.

The compositions of the invention may be used in a pure form to make an intermediate layer. One can thus obtain balls that are appreciated for their excellent feel, and for their initial high speeds. However, due to their weak elastic modulus, they tend to deform excessively at impact.

This problem may be solved advantageously by forming a compound of ether block copolymer and of ionomer(s). The ionomer(s) rate may vary from 0 to 90% by weight with respect to the total weight of the compound and is preferably comprised between 20 and 65%. The preferred ionomers have a shore D hardness comprised between 55 and 65, and a modulus of elasticity comprised between 250 and 350 N/mm$^2$. The preferred amide block copolyethers have a shore D hardness of 30–40. In this case, the proportion of amide block polyether in the composition is of 35–80%.

BRIEF DESCRIPTION OF THE DRAWING

The present invention will be better understood and its advantages will become more apparent from the following description of the embodiments.

DETAILED DESCRIPTION OF THE PREFERRED EMBODIMENTS

Figure 1:
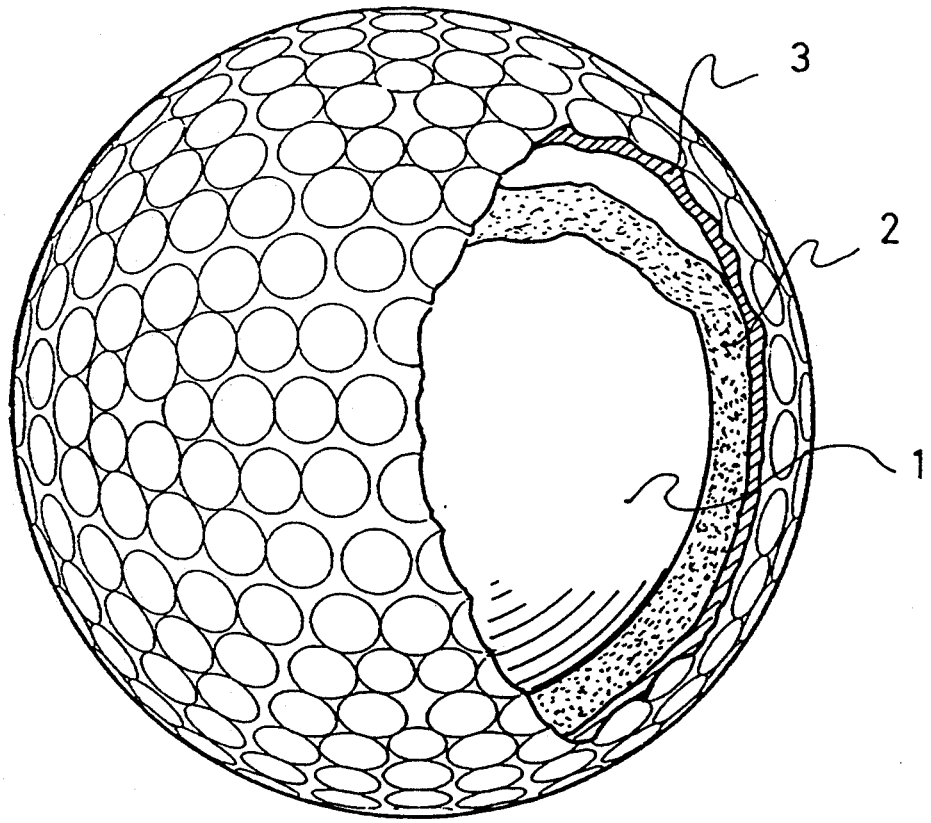
FIG. 1 is a partial sectional view of a golf ball according to the invention.

The ball of the invention is a ball of "three-piece" type, that is, it is constituted of three distinct layers.

As can be seen in FIG. 1, core 1 is constituted of a thermoplastic or thermohardenable or vulcanizable elastomer whose diameters are comprised between 34 and 38 mm. Its density is comprised between 1 and 1.3 g/cm$^3$ and its shore D hardness is located between 40 and 50. The compression of this core measured under a load of 150 kg is comprised between approximately 2.8 and 4.5 mm for a fixed diameter of 36 mm.

The elastomer especially preferred is a cross linked diene elastomer of the polybutadiene cis-1,4 type containing a reactive product formed of zinc oxide and zinc diacrylate. The composition also contains a cross linking agent such as dicumyl peroxide, for example.

The intermediate part 2 is an injectable and extrudable thermoplastic copolymer of amide block polyether and preferably of polyetheresteramide of the type whose obtention procedures is described in the French patent 2,273,021 by ATOCHEM.

As an example, the balls have been manufactured with an intermediate layer of pure PEBAX. The characteristics and properties are mentioned in the annexed Tables 1 and 2.

In a preferred embodiment, the intermediate part 2 is constituted of a compound of amide block polyether and of ionomer(s). Tables 3 and 4 indicate the characteristics and properties of balls whose intermediate layer is manufactured of a composition based on PEBAX 3533 ® and ESCOR ®.

Generally, layer 2 formed around core 1 has a thickness of approximately 1 to 3 mm, and a modulus of elasticity of between 15 and 250 N/mm$^2$. According to the type of copolymer used, the shore D hardness may vary between approximately 20–50. The influence of these parameters is important and affects the performance characteristics of the ball. Balls whose intermediate layer has a lesser shore hardness D of approximately 30–37 lesser modulus of elasticity for a given thickness, will be appreciated for their feel and their control because of their high rotational speed or "spin" speed. Conversely, balls whose intermediate layer has a shore D hardness of between 40 and 50 (greater flexion module) will be appreciated for their optimal initial speed and their durability.

A comparison of Tables 1 and 3 shows that if one added an ionomer to the ether block copolymer composition, the hardness values would not change. However, the modulus of elasticity in measured traction would increase considerably. This effect is especially interesting because the intermediate layer contributes to the mechanical resistance of the core at impact, and advantageously limits its deformation. The intermediate layer behaves dynamically like the elastic filamentary winding layer of the so-called "winding" force.

The assembly of the two parts, 1 and 2, forms the internal structure of the ball and has a compression of 2.5 to 4 under 150 Kgs for a total given diameter of 40 mm.

The external layer 3 forms the envelope or cover of the ball. It is made of a thermoplastic material and has a thickness comprised between 0.9 and 3 mm.

The choice of materials is relatively wide in view of the fact that the basic qualities required for the cover are resistance to impact and durability. Also, in order to conserve these characteristics for the ball according to the invention, it is important that the hardness of the cover be greater than that of the intermediate layer.

The range of shore D hardness allowed varies between 40–55 and preferably between 43 and 48, for a density of 0.8 to 1.2 grams/cm$^3$ and a modulus of elasticity of 30–280 N/mm$^3$.

Among the prefferred materials, one would preferably choose ionomers of the SURLYN ® type, commercialized by the company DUPONT DE NEMOURS or ionomers of the IOTEK ® type by EXXON, amide block copolymers of the type used for the intermediate layer but with greater hardness, ionomer and amide block copolymer compounds, thermoplastic polyurethanes as well as compounds of these materials.

The association of the three layers 1, 2 and 3 give rise to a finished ball with a diameter of between 42.7 and 42.8 mm, its compression measured under 150 Kg of load is comprised between 2.5 and 4 mm.

As an example, the physical characteristics, the behavior and the properties of several balls according to the invention have been compared to earlier balls that were commonly used commercially. The results are presented in Tables 1–4 that follow:

TABLE 1

| | INVENTION | | | | PRIOR ART | | |
|---|---|---|---|---|---|---|---|
| | | | | | | 3 Piece Balls | |
| | Ball 1 | Ball 2 | Ball 3 | Ball 4 | 2 Piece Balls | A | B |
| COMPOSITION | POLYBUTADIENE CIS-1,4 | | | | SOLID RUBBER CORE | ROLLED CORE | ROLLED CORE |
| DIAMETER (mm) | 36.4 | 36.4 | 36.4 | 36.4 | | | |
| DENSITY (g/cm$^3$) | 1.18 | 1.18 | 1.18 | 1.18 | | | |
| COMPRESSION in mm under 150 KG of constant load | 3.8 | 3.8 | 3.8 | 3.8 | | | |
| COMPOSITION | INTERMEDIATE AMIDE BLOCK POLYETHER (PEBAX) | | | | | | |
| SHORE HARDNESS (D) | 37 | 37 | 40 | 43 | | | |
| THICKNESS (mm) | 1.8 | 1.8 | 1.8 | 1.8 | | | |
| DENSITY (g/cm$^3$) | 1.01 | 1.01 | 1.01 | 1.01 | | | |
| ELASTICITY MODULUS IN TRACTION | 40 | 40 | 55 | 80 | | | |
| COMPOSITION | THERMOPLASTIC ENVELOPE | | | | SURLYN ® ENVELOPE | SURLYN ® ENVELOPE | BALATA ENVELOPE |
| SHORE HARDNESS (D) | 43 | 45 | 45 | 47 | | | |
| THICKNESS (mm) | 1.35 | 1.35 | 1.35 | 1.35 | | | |
| DENSITY (g/cm$^3$) | 1 | 1 | 1 | 1 | | | |
| ELASTICITY MODULUS IN TRACTION | 80 | 100 | 100 | 120 | | | |

TABLE 2

| | INVENTION | | | | PRIOR ART | | |
|---|---|---|---|---|---|---|---|
| | | | | | | 3 Piece Ball | |
| | Ball 1 | Ball 2 | Ball 3 | Ball 4 | 2 Piece Ball | A | B |
| DIAMETER (mm) | 42.7 | 42.7 | 42.7 | 42.7 | 42.7 | 42.7 | 42.7 |
| WEIGHT (G) | 45.5 | 45.4 | 45.5 | 45.4 | 45.5 | 45.5 | 45.3 |

TABLE 2-continued

| | INVENTION | | | | PRIOR ART | | |
|---|---|---|---|---|---|---|---|
| | | | | | | 3 Piece Ball | |
| | Ball 1 | Ball 2 | Ball 3 | Ball 4 | 2 Piece Ball | A | B |
| COMPRESSION (mm) | 3.7 | 3.6 | 3.4 | 3.1 | 2.8 | 3.3 | 3.2 |
| DRIVER: | | | | | | | |
| INITIAL SPEED VI (m/s) | 64.2 | 64.1 | 64.2 | 64.4 | 64.7 | 64.3 | 64.2 |
| ROTATION (SPIN) (t/mn) | 3800 | 3650 | 3600 | 3300 | 2900 | 3300 | 3700 |
| IRON 5: | | | | | | | |
| ROTATION (SPIN) (t/mn) | 7500 | 7300 | 7300 | 6800 | 5600 | 6500 | 7300 |
| PROPERTIES: | | | | | | | |
| CONTROL | B | B | E | E | M | B | E |
| FEEL AT IMPACT | B | B | E | B | M | B | E |
| DURABILITY | B | B | B | B | E | B | M |
| REPRODUCTABILITY | E | E | E | B | B | M | M |

E = EXCELLENT
B = GOOD
M = MEDIOCRE

TABLE 3

| | Ball 5 | Ball 6 | Ball 7 |
|---|---|---|---|
| COMPOSITION | ELASTOMER CORE POLYBUTADIENE CIS-1,4 | | |
| DIAMETER (mm) | 36.4 | 36.4 | 36.4 |
| DENSITY (g/cm3) | 1.18 | 1.18 | 1.18 |
| COMPRESSION in mm UNDER 150 KG | 3.8 | 3.8 | 3.8 |
| COMPOSITION | INTERMEDIATE LAYER (PEBA/IONOMER) | | |
| SHORE HARDNESS (D) | 37 | 40 | 43 |
| THICKNESS (mm) | 1.8 | 1.8 | 1.8 |
| DENSITY (g/mm3) | 1 | 1 | 1 |
| ELASTICITY MODULUS IN TRACTION (N/mm2) | 90 | 120 | 150 |
| COMPOSITION | THERMOPLASTIC ENVELOPE | | |
| SHORE HARDNESS (D) | 43 | 45 | 47 |
| THICKNESS (mm) | 1.35 | 1.35 | 1.35 |
| DENSITY (g/cm3) | 1 | 1 | 1 |
| ELASTICITY MODULUS IN TRACTION (N/mm2) | 90 | 100 | 120 |

TABLE 4

| | Ball 05 | Ball 06 | Ball 07 |
|---|---|---|---|
| DIAMETER (mm) | 42.7 | 42.7 | 42.7 |
| WEIGHT (G) | 45.5 | 45.4 | 45.5 |
| DRIVER: (46M/S) | | | |
| INITIAL SPEED (m/s) | 64.2 | 64.3 | 64.2 |
| ROTATION (SPIN) (T/mn) | 3800 | 3600 | 3400 |
| IRON 5: | | | |
| ROTATION (SPIN) (T/MN) | 7500 | 7300 | 6900 |
| PROPERTIES: | | | |
| CONTROL | E | E | B |
| FEEL AT IMPACT | B | E | B |
| DURABILITY | B | B | B |
| REPRODUCTABILITY | E | E | E |

E = EXCELLENT
B = GOOD
M = MEDIOCRE

The instant application is based upon French patent application 90.10696 of Aug. 22, 1990, the disclosure of which is hereby expressly incorporated by reference thereto, and the priority of which is hereby claimed.

What is claimed:

1. A golf ball comprising
a core comprising an elastomer material;
a cover comprising a thermoplastic material; and
an intermediate layer comprising a thermoplastic composition having at least 10% by weight of amide block copolyether with respect to the total weight of the composition.

2. A golf ball according to claim 1, wherein
said thermoplastic composition of said intermediate layer has at least 35% by weight of amide block copolyether with respect to the total weight of the thermoplastic composition.

3. A golf ball according to claim 1, wherein
said amide block copolyether is a polyetheresteramide.

4. A golf ball according to claim 1, wherein
said composition of said intermediate layer comprises an amide block copolyether and at least one ionomer.

5. A golf ball according to claim 1, wherein
said thermoplastic composition of said intermediate layer comprises an amide block copolyether and up to 90% by weight of at least one ionomer with respect to the total weight of the thermoplastic composition having a short D hardness between 55 and 65 and a modulus of elasticity between 250 and 350 $N/mm^2$.

6. A golf ball according to claim 1, wherein
said thermoplastic composition of said intermediate layer comprises an amide block copolyether and between 20 and 65% by weight of at least one ionomer with respect to the total weight of the thermoplastic composition having a short D hardness between 55 and 65 and a modulus of elasticity between 250 and 350 $N/mm^2$.

7. A golf ball according to claim 5, wherein
said thermoplastic composition of said intermediate layer comprises between 35 and 80% by weight of said amide block copolyether having a short D hardness between 30 and 40.

8. A golf ball according to claim 6, wherein
said thermoplastic composition of said intermediate layer comprises between 35 and 80% by weight of said amide block copolyether having a short D hardness between 30 and 40.

9. A golf ball according to claim 1, wherein
said core comprises a cross-linked diene elastomer.

10. A golf ball according to claim 9, wherein
said elastomer comprises polybutadiene cis 1,4.

11. A golf ball according to claim 1, wherein
said core has a shore D hardness between 40 and 50.

12. A golf ball according to claim 1, wherein
the core has a diameter in the range of 34–38 millimeters;

the combination of core and intermediate layer has a diameter in the range of 37–41 millimeters;

the combination of core, intermediate layer and cover has a diameter in the range of 42.7–42.8 millimeters;

the thickness of the intermediate layer is in the range of 1–3 millimeters;

the thickness of the cover is in the range 0.9–3 millimeters;

the combination of core, intermediate layer and cover has a compression in the range of 2.5–4 millimeters for a 150 Kg force;

the intermediate layer has a modulus of elasticity in the range of 15–250 $N/mm^2$; and the cover has a modulus of elasticity in the range of 30–280 $N/mm^2$.

13. A golf ball according to claim 12, wherein said core has a shore D hardness between 40 and 50.

14. A golf ball according to claim 1, wherein said cover comprises a material selected from the group consisting of ionomers, amide block copolymers, ionomer and amide block copolymer compounds and thermoplastic polyurethanes.

15. A golf ball according to claim 1, wherein the core has a diameter of 36 millimeters and a compression in the range of 2.8–4.5 millimeters for a 150 kg force.

16. A golf ball according to claim 1, wherein the core and the intermediate layer have a combined diameter of 36 millimeters and a compression in the range of 2.5–4 millimeters for a 150 kg force.

17. A golf ball comprising a core comprising an elastomer material;

a cover comprising a thermoplastic material; and an intermediate layer comprising a thermoplastic composition having at least 10% by weight of amide block copolyether with respect to the total weight of the composition, wherein said cover has a shore D hardness greater than the shore D hardness of said intermediate layer.

18. A golf ball according to claim 17, wherein said intermediate layer has a shore D hardness between 35 and 50.

19. A golf ball according to claim 17, wherein said cover has a shore D hardness between 40 and 55.

20. A golf ball according to claim 17, wherein said cover has a shore D hardness between 43 and 48.

* * * * *